United States Patent [19]

Memminger et al.

[11] 4,328,929

[45] May 11, 1982

[54] YARN DELIVERY APPARATUS FOR USE WITH TEXTILE MACHINES

[75] Inventors: Gustav Memminger, Freudenstadt; Josef Fecker, Bisengen; Wilfried Flister, Rottenburg, all of Fed. Rep. of Germany

[73] Assignee: Memminger GmbH, Freudenstadt, Fed. Rep. of Germany

[21] Appl. No.: 184,097

[22] Filed: Sep. 4, 1980

[30] Foreign Application Priority Data

Sep. 8, 1979 [DE] Fed. Rep. of Germany ..... 2936375

[51] Int. Cl.[3] ..... B65H 51/20

[52] U.S. Cl. ..... 242/47.01

[58] Field of Search ..... 242/47.01, 47.02, 47.03, 242/47.04, 47.05, 47.06, 47.08, 47.09, 47.1, 47.11, 47.12, 47.13; 139/452; 66/132 R

[56] References Cited

U.S. PATENT DOCUMENTS

| | | | |
|---|---|---|---|
| 4,114,823 | 9/1978 | Fecker et al. | 242/47.01 |
| 4,271,686 | 6/1981 | Memminger et al. | 242/47.01 X |
| 4,271,687 | 6/1981 | Memminger et al. | 242/47.01 X |

FOREIGN PATENT DOCUMENTS 898218 6/1962 United Kingdom .

*Primary Examiner*—Stanley N. Gilreath

*Attorney, Agent, or Firm*—Frishauf, Holtz, Goodman & Woodward

[57] ABSTRACT

To prevent kinks or twists formed upon uncontrolled removal of yarn from a storage drum from interfering with yarn withdrawal from the storage drum, an intermediate yarn guide element 20 is located between the lower edge 18 of the storage drum and the pull-off guide eye and is formed with at least one yarn guide edge located laterally with respect to the axis of rotation 24 of the drum 1 and in the path of the yarn from the storage winding to the removal guide eye. The yarn guide edge is extended to terminate into an elongated narrow guide slot 23 extending from the guide edge inwardly towards the axis of rotation of the drum. The intermediate yarn guide element is provided with a loop or kink deflecting element and comprises a re-entrant structure extending approximately parallel to and below the yarn guide element 20. In this loop deflection element 29 a narrow longitudinal slot 40 is formed which merges into the narrow guide slot 23 of the intermediate yarn guide element so that there are two slots present, one above the other, through which the yarn is passing. A movable sensing element for effecting stop-motion is provided.

5 Claims, 3 Drawing Figures

FIG. 1
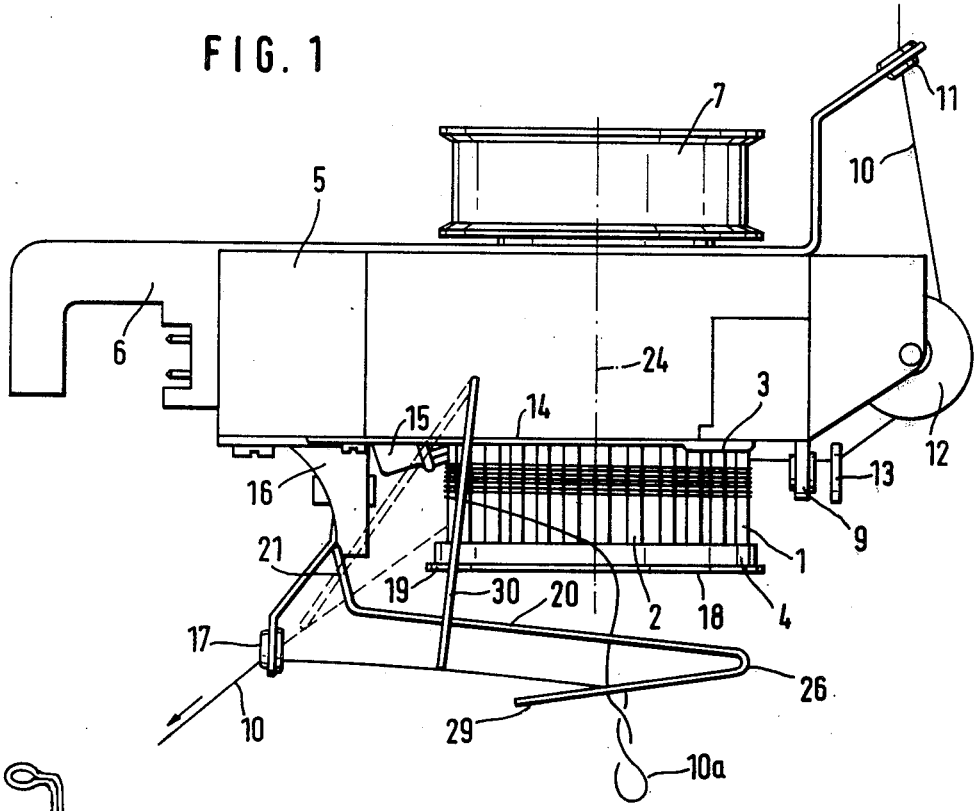
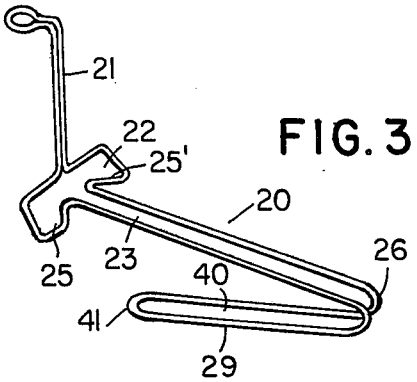
FIG. 3
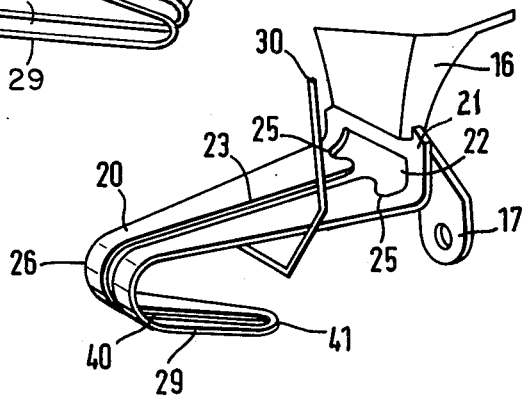
FIG. 2

YARN DELIVERY APPARATUS FOR USE WITH TEXTILE MACHINES

The present invention relates to yarn delivery apparatus for use in combination with textile machines, and more particularly for knitting machines, especially circular knitting machines, in which a revolving storage drum is provided on which a plurality of storage windings are looped. The yarn is supplied tangentially to the storage drum and is intended to be removed through a stationary yarn guide element, for example a yarn guide eye, located below and laterally of the lower edge of the drum. The yarn is drawn off the storage drum with the same speed as it is supplied to the storage drum and following a slanting yarn path that is directed downwardly. Between the lower edge of the storage drum and the yarn guide element there is provided an intermediate yarn guide element which is formed with at least one yarn guide edge located adjacent the path of the yarn from the storage winding to the yarn guide element and an elongated narrow guide slot extending from adjacent said guide edge towards the axis of rotation of the storage drum.

The yarn tension of the yarn being pulled-off can be sensed by a stop-motion sensor.

BACKGROUND AND PRIOR ART

The yarn delivery or yarn supply apparatus of the above mentioned type is described in U.S. Pat. No. 4,114,823 of the assignee of the present application. This yarn delivery apparatus is capable of handling highly twisted yarn or yarn with S- or Z-twists at low tension in the region between the storage drum and the utilization position without interference with pull-off due to formation of loops, kinks or uncontrolled twists.

The yarn is supported by the guide edge of the intermediate storage element on its path in advance of the yarn sensor. This permits operation of the textile machine with very low yarn tension. Upon trouble in the machine which, for example, results in loss of tension of the yarn and in the formation of loops or twists occuring with highly twisted yarns, the loops or twists are prevented from reaching the utilization position since the narrow guide slot, in which the yarn will be guided if tension is lost, or substantially decreased, prevents the further travel of kinks or loops or twists of the yarn upon itself, and permits automatic pull-off of the yarn in a single straight thread.

In one embodiment of this yarn delivery apparatus the intermediate guide element is formed with a loop or kink deflecting extension in the form of a generally U-shaped portion projecting below the portion of the element in which the elongated narrow guide slot is formed. The deflecting element prevents catching of the yarn on the intermediate guide element when using yarns that have a strong tendency of kinking. Any kinks or loops occuring when the yarn tension will decrease will be held off laterally of the intermediate guide element by the deflecting element.

This yarn delivery apparatus enjoys a considerable commercial success. Under certain operational conditions it would be desirable to further improve the guiding of the yarn pulled off the storage drum.

THE PRESENT INVENTION

It is an object of the present invention to provide a yarn delivery apparatus which is capable of handling highly twisted yarn or yarn S- or Z-twists at low tension in the region between the storage drum and the utilization position and in which the yarn pulled off the storage drum is more effectively guided. Briefly, the intermediate yarn guiding element that is located between the lower edge of the storage drum and the stationary yarn guide element and that is formed with a kink or loop deflecting element is provided with a narrow longitudinal slot in the deflecting element, that is merging into the narrow guide slot of the intermediate guide element.

Because of this narrow longitudinal slot in the kink or loop deflecting element two slots are present, one above the other in a predetermined distance and one merging into the other. Both slots are cooperating in perfectly guiding, at two separate points, the yarn that is drawn off the storage drum.

Drawings, illustrating and example:

FIG. 1 is a side view of the yarn delivery apparatus, in schematic representation, and omitting parts not necessary for the understanding of the invention;

FIG. 2 is a perspective view of the intermediate yarn guide element with its kink or loop deflecting element; and FIG. 3 is a perspective view of an alternative embodiment of the intermediate yarn guide element.

The yarn delivery apparatus of FIG. 1 is provided with a storage drum 1 which may have any suitable form but, in the preferred form as shown, it is constructed similar to a squirrel cage—to use terminology customary with electrical induction motors of similar form—in which two end disks 3, 4 have connecting pins or rods 2 located around the circumfence. Upon rotation, the outer circumference of the pins or rods 2 will form the envelope of a cylinder. The storage drum 1 is secured to a vertical shaft—not shown—which is journaled in a bracket or holder 5. The bracket 5 is formed with fastening means 6 in the form of a hook-like end portion so that the bracket 5 can be secured to the holding ring customary in circular knitting machines on which yarn supply drums are secured. The storage drum 1 is rotated by engagement with a suitable drive means, for example by being coupled to a pulley 7 around which a drive belt can be looped. The connection between the pulley 7 and the storage drum 1 is such that rotation is transmitted from the pulley 7 to the storage drum 1, the pulley 7 itself being engaged by a flat belt driven separately, or from the drive mechanism of the knitting machine.

A leading, or supply thread guiding eye 9 is located laterally and approximately at adjacent the upper level of the storage drum 1. Yarn 10, supplied from a yarn package (not shown) is guided through a first guide eye 11, through a thread brake 12 and then through an inlet eye 13 connected to a stop-motion sensor sensing the presence of thread being supplied to the supply eye 9. Supply eye 9 guides the thread tangentially onto the revolving storage drum 1.

The yarn forms a storage winding 14 on the drum 1. The storage winding 14 consists of a plurality of loops or wraps of the yarn around the storage drum 1. It is fed downwardly axially by suitable means, for example an inclined gear 15 which engages between the gaps formed by the spaced pins 2 of the storage drum 1. The gear 15 is located on a shaft secured to the holder 5 to be freely rotatable, so that it can be driven by the storage drum 1. Its axis of rotation is inclined with respect to a horizontal plane.

Laterally to the storage drum 1 and opposite to the supply eye 9 a holding bracket 16 is secured to bracket 5, for example by screws, and has a run-out, or pull-off thread guide element 17 secured thereto. The thread guide element 17 is formed as an eye with a horizontal axis, in order to guide the yarn 10 from the storage windings 14 on storage drum 1 to a utilization position, for example the feed of a knitting machine.

The yarn removal eye 17 is located laterally adjacent the storage drum 1, and is placed axially lower than the lower edge 18 of the storage drum 1. The lower disk 4 of the storage drum 1 has a radially extending flange 19 formed thereon, the yarn being pulled-off over the edge of the flange 19 laterally downwardly with an inclination due to the relative position of the guide eye 17 with respect to the storage drum 1.

An intermediate guide element 20 is located between the lower edge 18 of the storage drum 1 and the guide eye 17. The intermediate guide element 20 is fixed with respect to the storage drum 1 and, usually, is constructed as a sheet metal element which is essentially parallel to, or only slightly inclined with respect to the lower disk 4 of the storage drum 1. It is axially spaced from the lower disk 4. The intermediate guide element 20 has a support portion 21 which is approximately at a right angle to the direction of the path of the yarn 10 taken upon removal from the storage drum 1. The portion 21 is formed with a wide opening 22, from which a narrow guide slot 23 extends up to about the axis of rotation 24 of the storage drum 1. The guide slot 23 has its main axis located in a plane which includes the axis of rotation 24 of the storage drum 1 and the axis of the pull-off, or removal guide eye 17. It may also be located laterally adjacent this plane or inclined with respect to this plane. Its width is so selected that it is just slightly wider than the order of magnitude of the diameter of the thread 10 passing therethrough.

The opening 22 in the intermediate guide element 20 is formed to provide two guide edges 25, 25', located, respectively, at the lateral terminal ends of the narrow guide slot 23. The guide edges 25, 25' are located in respective depressions extending from the opening 22. The guide edges 25, 25' are thus formed by portions of the edges defining the opening 22, which extends transversely within the intermediate guide element 20.

The guide element 20 has and end portion 26 extending approximately to the edge of the storage drum 1 on the opposite side with respect to the yarn removal eye 17. It is formed with a loop or kink deflecting element 29 in the form of a general U-shaped portion (see FIG. 1) projecting below the portion 21 of the intermediate element 20 in which the slot 23 is formed. The loop deflecting element 29 tapers laterally, that is laterally conical as best seen in FIG. 2.

A narrow longitudinal slot 40 is formed in the loop deflecting element 20. The narrow slot 40 extends approximately parallel to the guide slot 23, and both slots 23 and 40 may have the same width. The narrow slot 40 merges into the guide slot 23, i.e. the unitary assembly formed by the intermediate guide element 20 and the loop deflecting element 29 is slotted at the curved end portion 26. The narrow slot 40 is closed at one end 41 within the loop deflecting element 29. It extends close to the axis of rotation 24 of the storage drum 1.

The two slots 23 and 40 need not necessaryly be parallel to each other; one may extend obliquely with respect to the other one.

The intermediate guide element 20 and the loop deflecting element 29 need not be constructed as a unitary sheet metal as illustrated specifically in FIG. 2; both parts 20, 29 could be made of wire which is bent according to the shape of the circumference of the slots 40 and 23 and of the opening 22 (see FIG. 3).

The thread pull-off sensor is formed as a general U-shaped bail 30 secured to the bracket 5. Bail 30 is pivotable about a generally horizontal axis, and the transverse portion of the bail 30 is normally positioned between the guide edge 25 and the pull-off thread guide element 17 where it is engaging the thread 10 pulled-off the storage drum 1. This position of the bail 30 is depicted in broken lines in FIG. 1. The bail 30 is biased by a suitable force applying element, the direction of the force being such that the bail 30 tends to tip or pivot towards the axis of rotation 24 of the storage drum 1. The force can be applied against the bail 30 by a spring, by a gravity linked weight connected to the bail, or the like. The bail 30 senses the tension of the thread 10 being pulled-off the storage drum 1. In normal, ordinary operation it will have the position illustrated in broken lines in FIG. 1. If the tension of the yarn decreases, bail 30 moves toward the right (FIG. 1) to reach a position which is approximately shown in FIG. 1. In this position, the contacts of the associated stop-motion device are operated to cause the machine to stop.

If the tension of the yarn 10 pulled-off the storage drum 1 should decrease the yarn 10 may from a loop or kink **10*a* (FIG. 1). This loop or kink 10*a* is prevented by the loop deflecting element 29 and the intermediate guide element 20** from catching a part of the yarn delivery apparatus or another portion of the pulled-off yarn. Thus an undesired breakdown of machine operation is prevented.

We claim:

1. Yarn delivery apparatus for use in textile machines comprising a storage drum (1) having a lower edge (18), on which at least one loop of yarn is wound to form a storage winding supply (14);

supply guiding means (9, 11, 12, 13) to guide yarn (10) to be supplied to a drum (1);

removal guiding means (17) to guide yarn being removed from the storage windings on the drum (1) and located laterally with respect to the axis of rotation (24) of the drum, an intermediate yarn guide element (20) located between the lower edge (18) of the drum (1) and said yarn removal guide means (17), said intermediate guide element (20) being formed with at least one yarn guide edge (25) located adjacent the path of the yarn from the storage winding to the removal guide means (17) and laterally with respect to the axis of rotation (24) of the drum and an elongated narrow guide slot (23) extending from adjacent said guide edge toward the axis of rotation (24) of the drum;

a movable yarn sensing element (30) located in a position between said yarn guide edge (25) and the yarn removal guide means (17), said yarn sensing element being biased for movement toward the axis of rotation (24) of the drum upon absent tension of yarn passing thereover from the storage windings of the drum toward the yarn removal guide means (17);

a loop deflection element (29) positioned below the intermediate yarn guide element (20) attached to the intermediate yarn guide element (20) and comprising a re-entrant structure extending essentially parallel to and below the yarn guide element (20);

and including, in accordance with the invention, a longitudinal narrow slot (40) formed in the loop deflecting element (29) and merging into said elongated narrow guide slot (23) of the intermediate guide element (20).

2. Apparatus according to claim 1, wherein the narrow slot (40) of the loop deflecting element (29) extends at least approximately parallel to the guide slot (23) of the intermediate guide element (20).

3. Apparatus according to claim 1, wherein the narrow slot (40) of the loop deflecting element (29) extends close to the axis of rotation (24) of the storage drum (1).

4. Apparatus according to claim 1, wherein the intermediate guide element (20) extends (at 26) close to the edge of the storage drum (1).

5. Apparatus according to claim 1, wherein the intermediate guide element (20) and the loop deflecting element (29) are formed as a unitary wire structure.

* * * * *